US010541475B2

(12) United States Patent
Caporal Del Barrio et al.

(10) Patent No.: US 10,541,475 B2
(45) **Date of Patent: *Jan. 21, 2020**

(54) TUNABLE MULTIPLE-RESONANCE ANTENNA SYSTEMS, DEVICES, AND METHODS FOR HANDSETS OPERATING IN LOW LTE BANDS WITH WIDE DUPLEX SPACING

(71) Applicant: wiSpry, Inc., Irvine, CA (US)

(72) Inventors: Samantha Caporal Del Barrio, Aalborg (DK); Gert Frølund Pedersen, Storvorde (DK); Arthur S. Morris, III, Raleigh, NC (US)

(73) Assignee: WISPRY, INC., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/189,769

(22) Filed: Nov. 13, 2018

(65) Prior Publication Data

US 2019/0190155 A1 Jun. 20, 2019

Related U.S. Application Data

(63) Continuation of application No. 14/885,779, filed on Oct. 16, 2015, now Pat. No. 10,128,573.

(Continued)

(51) Int. Cl.
*H01Q 9/04* (2006.01)
*H01Q 5/328* (2015.01)

(Continued)

(52) U.S. Cl.
CPC ..... *H01Q 9/0442* (2013.01); *H01Q 1/243* (2013.01); *H01Q 1/48* (2013.01); *H01Q 5/314* (2015.01);

(Continued)

(58) Field of Classification Search
CPC ..... H01Q 5/314; H01Q 5/328; H01Q 5/378; H01Q 5/385; H01Q 5/392; H01Q 5/321;

(Continued)

(56) References Cited

U.S. PATENT DOCUMENTS 6,882,318 B2 4/2005 Nevermann
7,215,283 B2 5/2007 Boyle (Continued)

FOREIGN PATENT DOCUMENTS

CN 1639909 A 7/2005
CN 1826708 A 8/2006

(Continued)

OTHER PUBLICATIONS

European Office Action for Application No. 15851082.6 dated Apr. 12, 2019.

(Continued)

*Primary Examiner* — Robert Karacsony
(74) *Attorney, Agent, or Firm* — Jenkins, Wilson, Taylor & Hunt, P.A.

(57) ABSTRACT

The present subject matter relates to antenna systems, devices, and methods that provide efficient coverage of low frequency bands (e.g., 700 MHz-bands and 600 MHz-bands) for the new generations of mobile communication. For example, a dual-resonant radiating system can include a ground plane, a radiating coupler spaced apart from but in communication with the ground plane, and a ground plane extension in communication with the ground plane. In this arrangement, one or both of the radiating coupler and the ground plane extension are tunable to tune a dual-resonance frequency response.

19 Claims, 7 Drawing Sheets

Related U.S. Application Data

(60) Provisional application No. 62/065,106, filed on Oct. 17, 2014.

(51) Int. Cl.

| | |
|---|---|
| ***H01Q 1/48*** | (2006.01) |
| ***H01Q 5/392*** | (2015.01) |
| ***H01Q 1/24*** | (2006.01) |
| ***H01Q 9/42*** | (2006.01) |
| ***H01Q 5/314*** | (2015.01) |

(52) U.S. Cl.
CPC ..... *H01Q 5/328* (2015.01); *H01Q 5/392* (2015.01); *H01Q 9/0414* (2013.01); *H01Q 9/42* (2013.01)

(58) Field of Classification Search
CPC ..... H01Q 5/335; H01Q 1/243; H01Q 1/48; H01Q 9/42; H01Q 9/0442; H01Q 9/0414; H01Q 9/0421; H01Q 9/045; H01Q 9/0457
See application file for complete search history.

(56) References Cited

U.S. PATENT DOCUMENTS

| | | | |
|---|---|---|---|
| 7,423,598 | B2 | 9/2008 | Bit-Babik et al. |
| 7,843,397 | B2 | 11/2010 | Boyle |
| 8,098,756 | B2 | 1/2012 | Yamamoto et al. |
| 8,144,072 | B2 | 3/2012 | Chiang et al. |
| 9,472,846 | B2 | 10/2016 | Ng et al. |
| 9,680,223 | B2 | 6/2017 | Wu et al. |
| 10,128,573 | B2 * | 11/2018 | Caporal Del Barrio ..... H01Q 1/243 |
| 2006/0055606 | A1 | 3/2006 | Boyle |
| 2006/0214857 | A1 | 9/2006 | Ollikainen |
| 2008/0007468 | A1 | 1/2008 | Sato |
| 2008/0136727 | A1 | 6/2008 | Bit-Babik et al. |
| 2008/0252536 | A1 | 10/2008 | Anguera et al. |
| 2010/0195753 | A1 | 8/2010 | Yamamoto et al. |
| 2011/0032170 | A1 | 2/2011 | Chiang et al. |
| 2012/0146865 | A1 | 6/2012 | Hayashi et al. |
| 2012/0306718 | A1 | 12/2012 | Koyanagi |
| 2014/0062813 | A1 | 3/2014 | Alrabadi et al. |
| 2014/0256273 | A1 | 9/2014 | Pelosi et al. |
| 2015/0054698 | A1 | 2/2015 | Kerr et al. |
| 2015/0236417 | A1 | 8/2015 | Iellci |
| 2016/0111784 | A1 | 4/2016 | Caporal Del Barrio et al. |

FOREIGN PATENT DOCUMENTS

| | | | |
|---|---|---|---|
| CN | 201387935 | Y | 1/2010 |
| CN | 103348532 | A | 10/2013 |
| CN | 107078377 | A | 8/2017 |
| EP | 1670093 | A1 | 6/2006 |
| EP | 3207588 | A1 | 8/2017 |
| WO | WO 2009/026304 | A1 | 2/2009 |
| WO | WO 2016/061536 | A1 | 4/2016 |

OTHER PUBLICATIONS

International Search Report and Written Opinion for Application No. PCT/US2015/056065 dated Jan. 27, 2016.
Non-Final Office Action for U.S. Appl. No. 14/885,779 dated Jan. 13, 2017.
Final Office Action for U.S. Appl. No. 14/855,779 dated Aug. 28, 2017.
Interview Summary for U.S. Appl. No. 14/855,779 dated Nov. 3, 2017.
Advisory Action with AFCP Decision and Interview Summary for U.S. Appl. No. 14/885,779 dated Dec. 21, 2017.
Notice of Allowance for U.S. Appl. No. 14/885,779 dated Mar. 7, 2018.
Supplementary European Search Report for European Application No. 15851082 dated May 3, 2018.
Notice of Allowance for U.S. Appl. No. 14/885,779 dated Jul. 16, 2018.
Chinese Office Action for Application No. 201580055974.2 dated Dec. 28, 2018.

* cited by examiner

TUNABLE MULTIPLE-RESONANCE ANTENNA SYSTEMS, DEVICES, AND METHODS FOR HANDSETS OPERATING IN LOW LTE BANDS WITH WIDE DUPLEX SPACING

CROSS-REFERENCE TO RELATED APPLICATION

The present application is a continuation patent application of U.S. patent application Ser. No. 14/885,779, filed Oct. 16, 2015, which claims the benefit of U.S. Provisional Patent Application Ser. No. 62/065,106, filed Oct. 17, 2014, the disclosures of which are incorporated herein by reference in their entireties.

TECHNICAL FIELD

The subject matter disclosed herein relates generally to antenna systems, devices, and methods. More particularly, the subject matter disclosed herein relates to antenna designs for use with radio communications systems, devices, and methods.

BACKGROUND

The fourth Generation (4G) of mobile communications standardized Long Term Evolution (LTE) and LTE-Advanced (LTE-A) technologies in order to provide higher data rates to consumers. 4G is being deployed on new and different frequency bands around the globe, however, which has led to band proliferation. Consequently, where it is desired for users to be able to maintain connectivity over any of these 4G frequency bands, device antennas need to cover about 40 bands in Frequency Division Duplex (FDD) and Time Division Duplex (TDD), with the number of bands likely to increase further in future generations. In this regard, world-wide mobile data access has multiplied the number of bands allocated to mobile communication by a factor of ten compared to speech-only specifications (e.g., 2G). Specifically, fourteen bands are defined in the low frequency range of the 4G spectrum today and represent nearly all the frequencies between 699 MHz and 960 MHz. Additionally, part of the frequency spectrum previously used for television broadcasting in frequencies ranging from 600 MHz to 698 MHz is being put up for auction to carriers, and still lower frequencies are being considered.

Designing a handset antenna in the low bands of 4G has shown to be a challenge for antenna engineers, as the antenna bandwidth and operating frequency vary inversely proportionally with the antenna volume provided a constant efficiency. Thus, to both lower the antenna resonance frequency and to enhance its bandwidth, the antenna volume needs to be increased. Conversely, however, consumer demand for smaller and slimmer designs, along with the drive to fit more components into smart-phones (e.g., cameras, large battery, high-end screen), incentivizes device manufacturers to develop antenna footprints that are as small as possible for newer generations of smart-phones. As a result, over the past decade, antenna engineers have pushed the low bound of their design from 824 MHz to 699 MHz while at the same time reducing the antenna volume. This combination of low resonance frequency and smaller antenna volume can often cause efficiency degradation, which impacts communication performance. These problems may be further exacerbated by attempts to utilize the new bands available in the low band, which have to be pushed by an extra 100 MHz.

Accordingly, it would be desired for antenna systems, devices, and methods to provide efficient coverage of low frequency bands (e.g., 700 MHz-bands and 600 MHz-bands) for the new generations of mobile communication.

SUMMARY

In accordance with this disclosure, antenna systems, devices, and methods for use with radio communications systems, devices, and methods are provided. In one aspect, a multiple-resonant radiating system is provided. Such a system can include a ground plane, a radiating coupler spaced apart from but in communication with the ground plane, and a ground plane extension in communication with the ground plane. In this arrangement, one or both of the radiating coupler and the ground plane extension are tunable to tune a multiple-resonance frequency response.

In another aspect, a multiple-resonant radiating system comprises a ground plane, a radiating coupler spaced apart from but in communication with the ground plane, a first tunable element connected between a coupler connection of the radiating coupler to the ground plane and a ground, a series tunable capacitor connected between the coupler connection of the radiating coupler to the ground plane and a feed node, a ground plane extension in communication with the ground plane, and a second tunable element connected to the ground plane extension. In this configuration, the first tunable element and the series tunable capacitor can be configured to tune a resonant frequency of the radiating coupler, and the second tunable element can be configured to tune a resonant frequency of the ground plane.

In yet another aspect, a method for operating an antenna is provided. The method can include tuning a first resonant frequency of a radiating coupler that is spaced apart from but in communication with a ground plane and tuning a second resonant frequency of a combination of the ground plane and a ground plane extension that is in communication with the ground plane. In this way, the first resonant frequency and the second resonant frequency can add constructively to form a multiple-resonance frequency response. In addition, a further benefit of the present systems and methods is that the ground can be tuned to a lower frequency to match the antenna operating frequency, which can leads to enhanced efficiency.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1A:
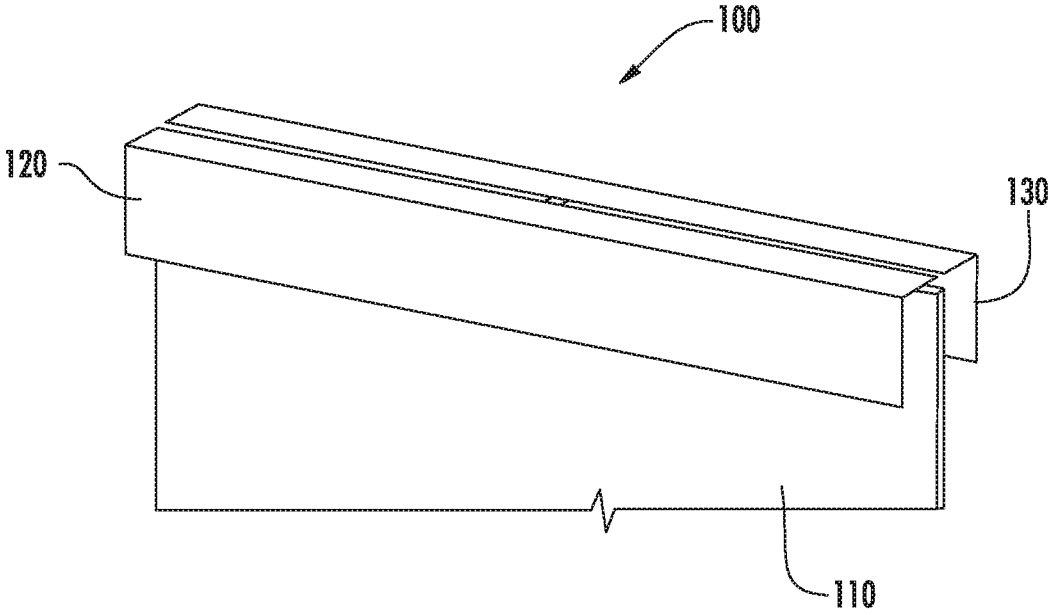
FIGS. 1A and 1B are perspective front views of a tunable dual-resonance antenna according to an embodiment of the presently disclosed subject matter.

To provide mobile high-speed internet as well as calling experiences world-wide, it can be desirable that the mobile device antenna is configured to cover a bandwidth of 360 MHz in the low bands of 4G (i.e., 600 MHz to 960 MHz). With this range of over 300 MHz of tuning for the antenna resonance frequency, it is understood that the antenna Quality factor (Q) increases as the antenna is tuned, which can cause the bandwidth to decrease. Although the instantaneous bandwidth needed for future systems at 600 MHz is still undetermined, the channel bandwidths of existing 4G bands range between 1.4 MHz and 20 MHz. Accordingly, with the duplex spacing being likely to be between 10 MHz and 40 MHz, the required antenna bandwidth could be 60 MHz at 600 MHz. Those having skill in the art will recognize that it is a major challenge to make an efficient design for this specification in a typical smart-phone form factor.

Accordingly, the present subject matter provides a design that combines a tunable antenna and a tunable ground plane (GP) extension in order to create a multiple-resonance antenna. The multiple-resonance concept is used to cover transmitting (TX) and receiving (RX) channels, which exhibit a large duplex spacing in low frequency bands (e.g., 600 MHz-bands may have 40 MHz duplex and 20 MHz channels). As a result, duplex spacing is not an issue and only the channel bandwidth needs to be covered with one antenna resonance.

In one aspect, the present subject matter provides an antenna design that achieves a multiple-resonance frequency response. In one exemplary configuration illustrated in FIGS. 1A through 1D, an antenna, generally designated 100, includes a ground plane 110, one or more radiating coupler 120 that is spaced apart from but is in communication with ground plane 110, and a ground plane extension 130 that is in communication with ground plane 110. In particular, in some embodiments, ground plane 110 extends under radiating coupler 120 and ground plane extension 130. In this way, no cut-back in ground plane 110 is needed to accommodate radiating coupler 120, ground plane extension 130, and/or any tuning elements connected to these components. As a result, although the inclusion of ground plane extension 130 adds volume to the mobile device, substantial modifications to the configuration of ground plane 110 are not necessary, which can be considered advantageous to device manufacturers. As used herein, the term "ground plane" should be understood by those having ordinary skill in the art to identify a conductive plane. As a result, ground plane 110 can be provided in any of a variety of known configurations, including those that are not completely planar.

Figure 1B:
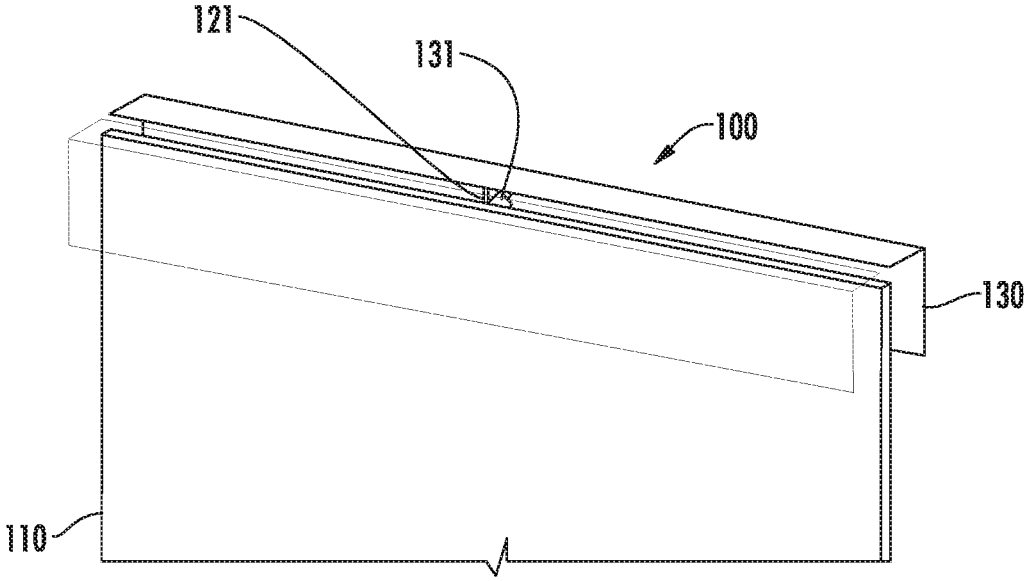
Figure 1C:
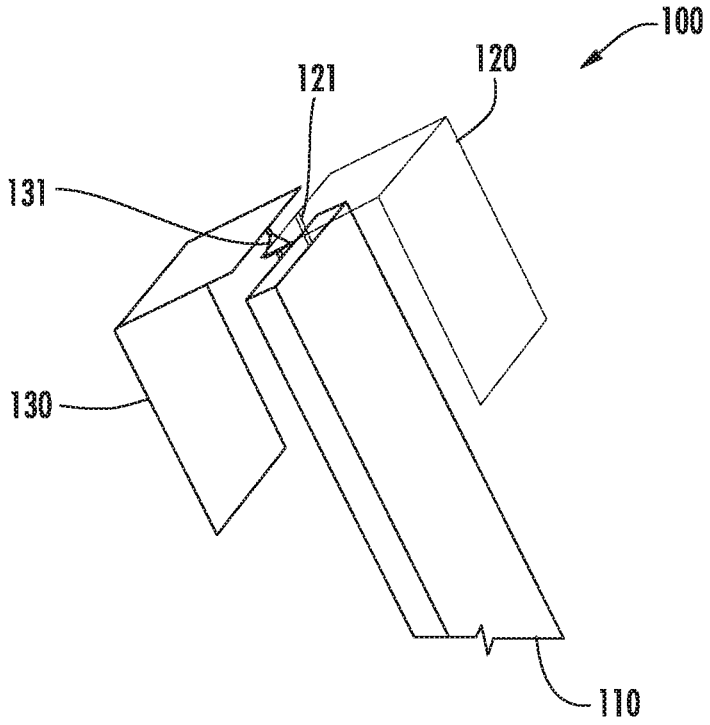
FIG. 1C is a perspective side view of the tunable dual-resonance antenna shown in FIGS. 1A and 1B.
Figure 1D:
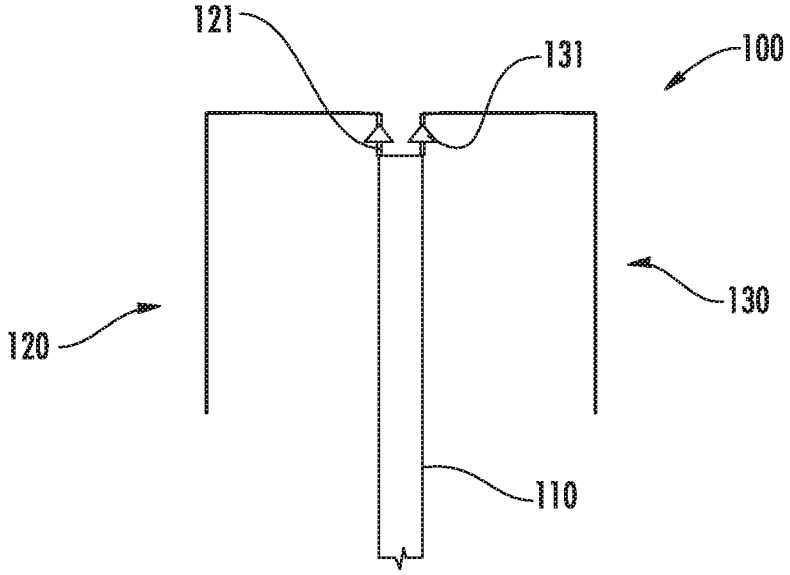
FIG. 1D is a side view of the tunable dual-resonance antenna shown in FIGS. 1A and 1B.

In some embodiments, both of radiating coupler 120 and ground plane extension 130 can be provided as planar inverted L antennas (ILA) that are in communication with ground plane 110. Specifically, for example, in the particular configuration illustrated in FIGS. 1A through 1D, radiating coupler 120 is connected to ground plane 110 at a coupler connection 121 that is positioned at or near an edge of ground plane 110 (e.g., where ground plane 110 has a substantially rectangular shape, radiating coupler 120 can be positioned along a shorter edge of the rectangular shape). In some embodiments, as illustrated in FIGS. 1A through 1C, radiating coupler 120 can be center fed. Likewise, ground plane extension 130 can be connected to ground plane 110 at a ground extension connection 131 that is positioned at or near the same edge of ground plane 110. In some embodiments, ground plane extension 130 can be center tuned (See, e.g., FIGS. 1A through 1C), and/or ground plane extension 130 can be tuned on several points connecting ground plane 110 to ground plane extension 130. In some embodiments, radiating coupler 120 and ground plane extension 130 can be substantially the same size and shape (e.g., about 4 mm×6 mm×55 mm compared to ground plane 110 having dimensions of about 55 mm×120 mm×1 mm) and can be positioned symmetrically on either side of ground plane 110 as shown in FIGS. 1A through 1D. There is no direct connection between radiating coupler 120 and ground plane extension 130.

Alternatively, those having skill in the art will recognize that the dimensions of radiating coupler 120 and ground plane extension 130 can be modified based on the particular design constraints of a given device (e.g., smaller elements may be desired in order to enhance compactness). As discussed above, the size of the elements is general inversely proportional to the achievable bandwidth of the antenna. Additionally, the size of the elements can further be inversely proportional to the values of tuning elements (e.g., tunable capacitors and/or inductors) in the circuitry that allow the frequency band of antenna 100 to be tuned. Accordingly, those having ordinary skill in the art will recognize that several combinations of antenna geometry, capacitance, and inductance can achieve the same or similar multiple-resonance frequency response.

Moreover, in some embodiments, radiating coupler 120 and ground plane extension 130 need not be symmetrical in order to constructively add their frequency response. For example, ground plane extension 130 can exhibit a more compact design to reduce the total volume of antenna 100 and/or ground plane extension 130 can provide a more robust connection to ground plane 110, while the configuration of radiating coupler 120 remains unchanged, and the multiple-resonance capabilities of antenna 100 are maintained. In addition, in some embodiments, radiating coupler 120 and ground plane extension 130 are not co-located (e.g., radiating coupler 120 can be connected at the top of ground plane 110 and ground plane extension 130 can be connected at the bottom of ground plane 110).

In any configuration, radiating coupler 120 can be configured to resonate at a desired high bound (e.g., about 900 MHz corresponding to a high bound of the LTE band) and can be tuned to lower frequencies (e.g., about 600 MHz corresponding to a low bound of the LTE bands). Ground plane 110 is also put in resonance, which can be lowered by the connection of ground plane extension 130 (e.g., to about 900 MHz as well). Furthermore, in some embodiments, ground plane extension 130 can be tuned so that ground plane 110 effectively becomes electrically larger, and its resonance frequency can thereby be decreased (e.g., to about 600 MHz). These two independently tunable resonances of the radiation coupler 120 and the combination of ground plane 110 and ground plane extension 130 can add constructively to form a dual resonance and enhance the antenna bandwidth. This additive resonance can be particularly beneficial for elements operating at frequencies at which the radiation parts are smaller than a quarter of the operating wavelength. In particular, as discussed above, coverage at low resonance frequencies with small antennas is challenging because the antenna bandwidth reduces as the antenna becomes electrically smaller (i.e., when the operating frequency decreases). Accordingly, this configuration of antenna 100 makes it possible to more efficiently cover 700 MHz-LTE-bands and to offer coverage to 600 MHz-bands with a wide duplex spacing, all while keeping a low profile. In fact, in some embodiments, the efficiency is enhanced by about 2 dB when the ground plane extension is used.

In addition, although FIGS. 1A through 1D illustrate a configuration in which one radiating coupler 120 and one ground plane extension 130 are provided in communication with ground plane 110, those having skill in the art should recognize that the concepts discussed herein can be extended to include configuration in which multiple radiating couplers are provided with antenna 100. Specifically, for example, one or more additional radiating coupler can be provided to tune a high frequency band in addition to the low bands corresponding to 4G communications. In this way, three or more resonant frequencies can be tuned simultaneously, thereby providing further enhancements to the instantaneous antenna bandwidth, providing an additional resonance to the harmonic resonance, and/or providing multiple resonances in configurations where the radiator is designed with multiple arms so that there is still a unique radiator and a unique feeding point associated with each resonance.

Figure 2:
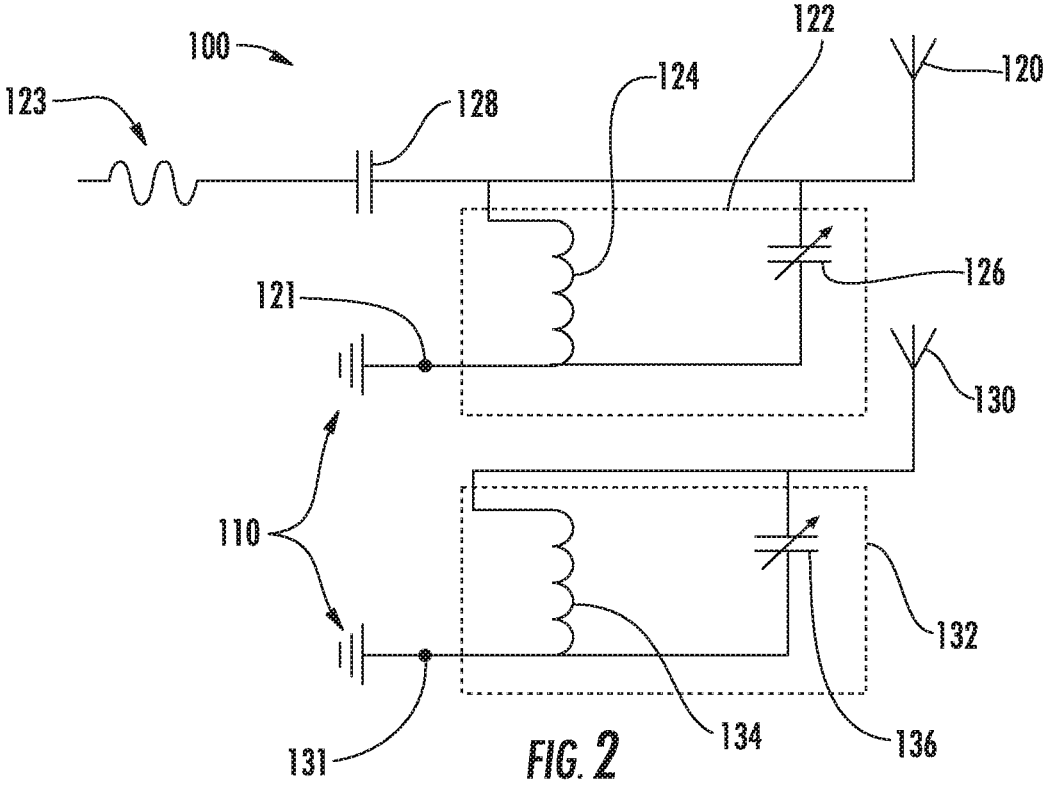
FIG. 2 is a schematic representation of a configuration for tuning elements for use with a tunable dual-resonance antenna according to an embodiment of the presently disclosed subject matter.

To achieve this tuning, one or more tunable elements can be provided in communication with one or both of radiating coupler 120 and/or ground plane extension 130. In particular, for example, radiating coupler 120 can be tuned with a first tunable element 122 that is connected between coupler connection 121 and a ground. In one particular configuration shown in FIG. 2, for example, first tunable element 122 can comprise a first fixed inductor 124 that is connected in parallel with a first tunable capacitor 126 between coupler connection 121 and a ground. Alternatively, first tunable element 122 can be any of a variety of other elements that is tunable to achieve a desired inductance, including for example a series combination of a fixed inductor and a tunable capacitor. In any arrangement, first fixed inductor 124 can be formed using the metal structure used to form radiating coupler 120 itself (i.e., part of the copper used to form radiating coupler 120, which can improve efficiency and simplify the circuitry), it can be formed using wire, or it can be formed using any other known configuration.

Furthermore, in addition to first tunable element 122, tuning can also be provided by a series tunable capacitor 128 connected between coupler connection 121 and a feed node 123. Series tunable capacitor 128 can be provided as a single tunable capacitor, as a parallel combination of a fixed capacitor and a tunable capacitor, as a series combination of a fixed capacitor and a tunable capacitor, or in any other known configuration for achieving a desired tunable capacitance.

In some embodiments, to help maintain a compact design for antenna 100, radiating coupler 120 can be shaped to follow the edges of the cover of the mobile device in which antenna 100 is provided, and one or more of first tunable element 122 (e.g., including first fixed inductor 124 and first tunable capacitor 126) and series tunable capacitor 128 can be low profile components that can be positioned between radiating coupler 120 and ground plane 110. In this way no cut-back in ground plane 110 is needed to accommodate radiating coupler 120 and/or its tuning elements.

Regardless of the particular configuration, first tunable element 122, either alone or in combination with series tunable capacitor 128, can be configured to achieve desired values for capacitance and inductance corresponding to a desired tuning state for radiating coupler 120. In one embodiment, for example, values of the tuning elements can provide about 5.5 pF maximum capacitance (e.g., with tuning steps of about 0.1 pF) and about 6 nH inductance for radiating coupler 120. Those having ordinary skill in the art will recognize, however, that the values needed for these elements can be selected based on the particular dimensions and configurations of radiating coupler 120, as the relationship between the tuning values and the achievable bandwidth and efficiency can vary with different antenna geometries.

Similarly, ground plane extension 130 can be tuned with a second tunable element 132 that is connected between ground plane extension 130 and ground plane 110. In particular, for example, second tunable element 132 can comprise a second fixed inductor 134 that is connected in parallel with a second tunable capacitor 136 between ground plane extension 130 and ground plane 110. Alternatively, second tunable element 132 can be any of a variety of other element that is tunable to achieve a desired inductance, including for example a series combination of a fixed inductor and a tunable capacitor. In any arrangement, second fixed inductor 134 can be formed using the metal structure used to form ground plane extension 130 itself (i.e., part of the copper used to form ground plane extension 130, which can improve efficiency and simplify the circuitry), it can be formed using wire, or it can be formed using any other known configuration. As with the tuning components connected to radiating coupler 120, in some embodiments, to help maintain a compact design for antenna 100, ground plane extension 130 can be shaped to follow the edges of the mobile device, and second tunable element 132 (e.g., including second fixed inductor 134 and second tunable capacitor 136) can be positioned between ground plane extension 130 and ground plane 110.

Regardless of the particular configuration, second tunable element 132 can be configured to achieve desired values for capacitance and inductance corresponding to a desired tuning state for ground plane extension 130. In this way, for example, as the value of the inductance of second tunable element 132 varies, the electrical length of ground plane 110 varies, and thus the resonance of ground plane 110 can be tuned. In one embodiment, for example, values of the inductance of second tunable element 132 can be varied between about 6 nH to about 26 nH to achieve resonance shifting from 930 MHz to 600 MHz for ground plane 110. Those having ordinary skill in the art will recognize that the values needed for these elements can be selected based on the particular dimensions and configurations of ground plane 110 and ground plane extension 130, as the relationship between the tuning values and the achievable bandwidth and efficiency can vary with varying antenna dimensions. In the case of any of first tunable element 122, series tunable capacitor 128, and/or second tunable element 132, the tunable capacitances can be realized with Micro-Electro-Mechanical Systems (MEMS) tunable capacitors, semiconductor technologies, variable dielectrics, or a combination of these. For example, MEMS devices are considered state of the art in terms of insertion loss, footprint, and voltage handling, which thus makes the technology a great candidate for tunable antennas. Regardless of the particular configuration, antenna 100 can be able to cover all the bands from 960 MHz (upper GSM limit) to 600 MHz (lowest LTE frequency planned) in 4 tuning stages. In addition, each resonance can be independently tunable, allowing for different duplex spacing values.

With antenna 100 being configured as discussed above to achieve a dual-resonance response, an enhanced bandwidth can be achieved that is enough to simultaneously cover TX and RX channels at low frequencies (e.g., 600 MHz-bands) while keeping an acceptable volume from the perspective of phone manufacturers. This design can be configured to optimize the resonance so that maximum efficiency is obtained at the operating channels and not in the frequency range between them. Furthermore, since antenna tuning decreases the antenna bandwidth as the antenna is tuned further away from its natural resonance, dual-resonance antenna systems and devices as discussed above can enhance the bandwidth, and independent tunability of each resonance allows for non-continuous coverage of both TX and RX channels, which can be desirable to cope with wide duplex spacing and optimize efficiency at operating frequencies only. As a result, the present subject matter can make coverage on 600 MHz-bands more practical, and it can make coverage on 700 MHz-bands more efficient, all without the need for a cut-back for the antenna.

Figure 3:
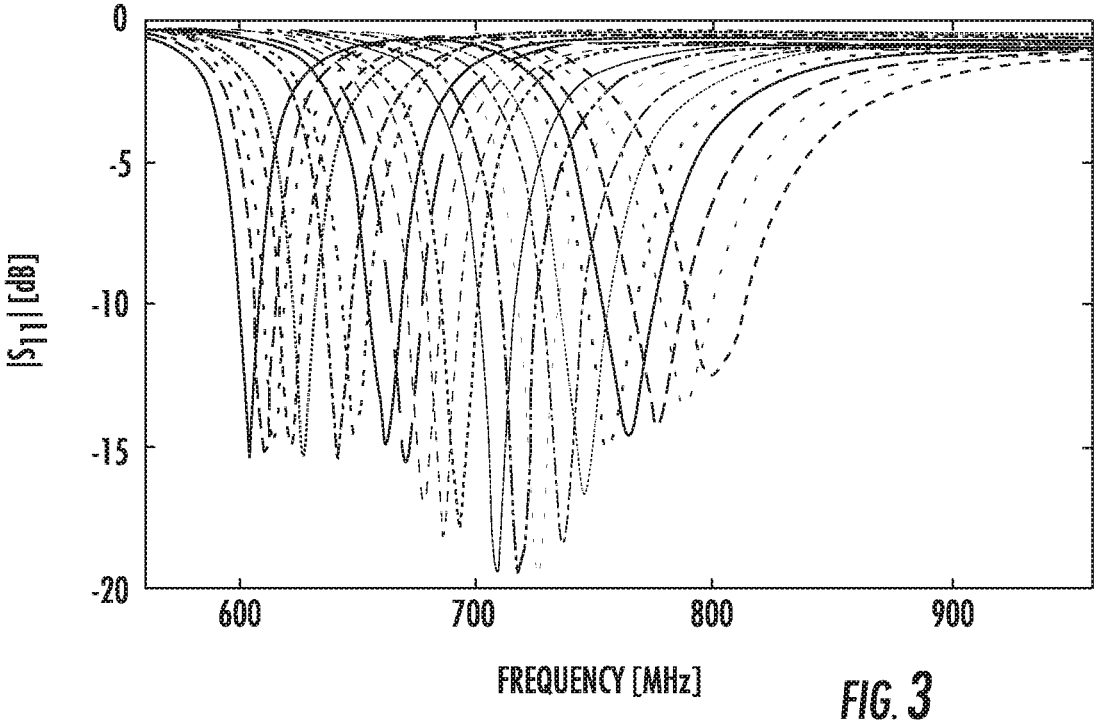
FIG. 3 is a graph illustrating measured return loss for different tuning stages of a reference tunable antenna.
Figure 4:
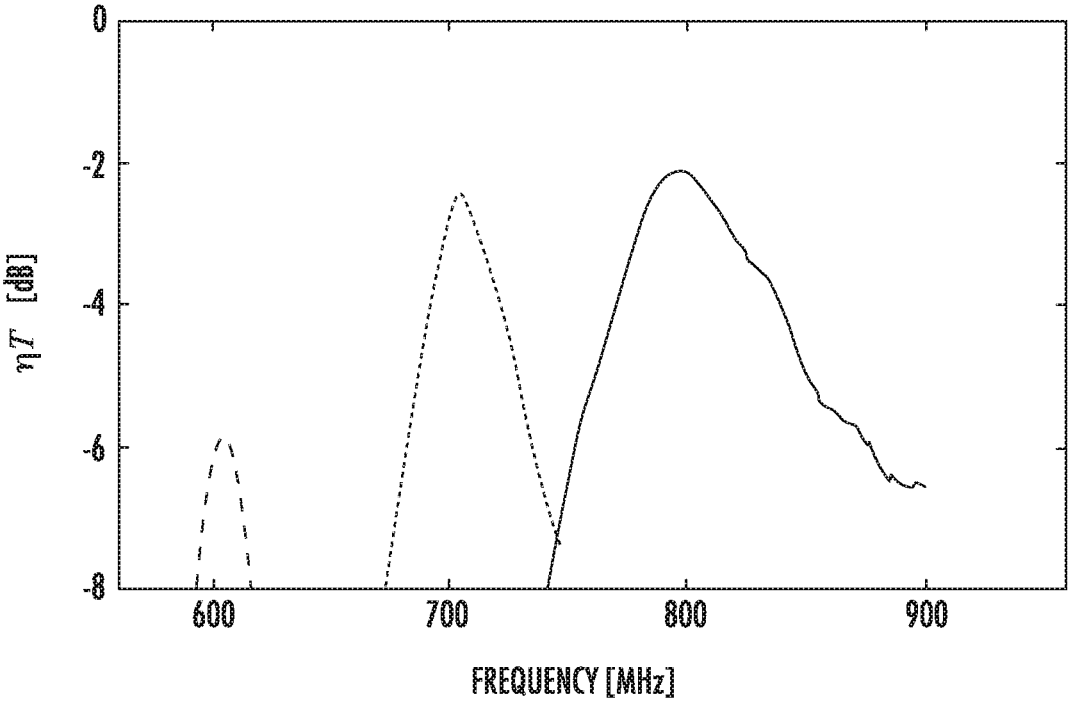
FIG. 4 is a graph illustrating measured efficiency for different tuning stages of a reference tunable antenna.

Specifically, for example, simulation results for the tunability of antenna 100 are provided in FIGS. 3 through 10. Firstly, to provide a basis of comparison, FIGS. 3 and 4 illustrate return loss and peak efficiency, respectively, for a reference configuration in which no ground plane extension 130 is connected to ground plane 110. As shown in FIG. 3, return loss for a classical single resonance antenna being tuned over the low frequencies of the communication spectrum is observed. In this exemplary configuration, the impedance bandwidth at −6 dB shrinks as the antenna is tuned, varying from 51 MHz at the highest bound to 17 MHz at the lowest bound. In FIG. 4, efficiency is plotted for three stages of the MEMS tunable capacitor: a minimum capacitance (e.g., about 0.5 pF), a mid-range capacitance (e.g., about 3.0 pF), and a maximum capacitance (e.g., about 5.9 pF). It can be observed that the total efficiency decreases as the antenna is tuned towards lower operating frequencies. Indeed, in this particular test case, the measured peak total efficiency of design 0 decreases from −2.1 dB at 800 MHz to −2.5 dB at 700 MHz and to −5.9 dB at 600 MHz. The drop between 700 MHz and 600 MHz is very significant.

Figure 5:
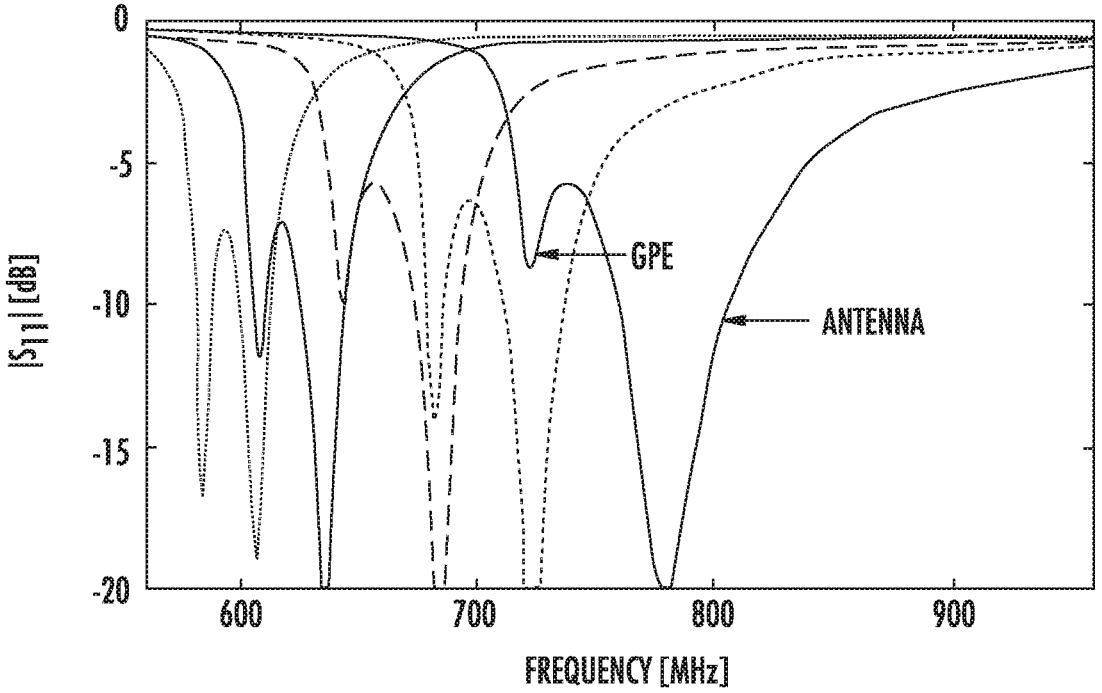
FIG. 5 is a graph illustrating measured return loss for different low-band tuning stages of a tunable multiple-resonance antenna according to an embodiment of the presently disclosed subject matter.
Figure 6:
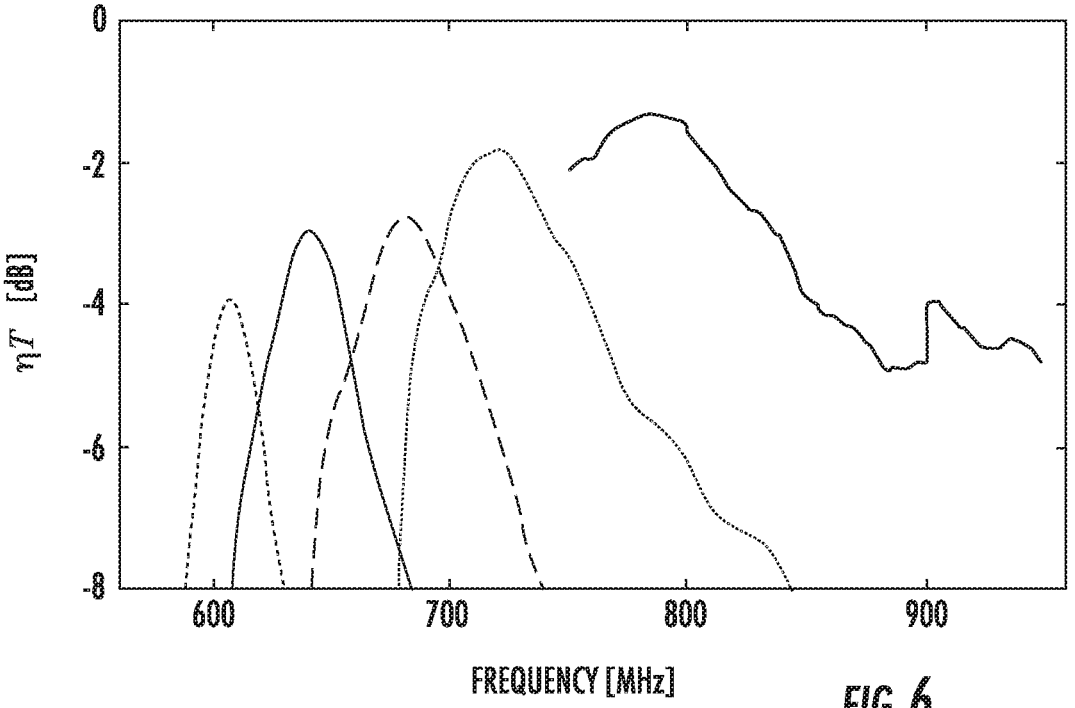
FIG. 6 is a graph illustrating measured efficiency for different low-band tuning stages of a tunable multiple-resonance antenna according to an embodiment of the presently disclosed subject matter.

In comparison, FIGS. 5 through 8 illustrate return loss and efficiency measurements of an exemplary configuration of antenna 100 in which first tunable element 122 and second tunable element 132 are provided on a MEMS tuner exhibiting high maximum capacitance (e.g., a model 1040 MEMS tuner produced by WiSpry, Inc.). With this arrangement, FIG. 5 illustrates the return loss for antenna 100 when operated in low frequency bands. As can be seen in FIG. 5, the design exhibits a dual-resonance. Radiating coupler 120 is responsible for one of them, and ground plane extension 130 is responsible for the other one. The resonance of radiating coupler 120 is the one that exhibits the best match and the widest bandwidth, whereas ground plane extension 130 cannot be a standalone resonance, as it is not fed directly. Referring to FIG. 6, the total efficiency of this exemplary configuration when operating at low-band tuning settings is shown. The peak total efficiency varies from −1.4 dB at 785 MHz to −3.9 dB at 609 MHz. The mismatch loss is negligible, since one can observed in FIG. 5 that the return loss is below −15 dB. Therefore, the total and the radiation efficiencies are indistinguishable.

The contribution of each component to the total loss can be isolated. Specifically, radiating coupler 120 and ground plane extension 130 have different reactances and different current densities, which explains the difference in dissipated power. Moreover, the power dissipated by second fixed inductor 134 differs between the reference configuration tested to obtain the measurements in FIGS. 3 and 4 and the configuration tested for the measurements in FIGS. 5 and 6, which is due to a lower Q of radiating coupler 120 (because ground plane extension 130 is added), thus a lower current density. Similarly, the conductive loss (e.g., from the combination of copper, trace, and Fr-4 elements) is decreased for the dual-resonance configuration compared to the reference design. This is also due to the lower Q that the dual-resonance configuration exhibits due to the inclusion of ground plane extension 130. The total simulation loss is 4.7 dB, which is found by adding the total radiation loss and the mismatch loss. The simulated radiation loss and the measured radiation loss at 600 MHz (−4.6 dB and −3.9 dB, respectively) differ by 0.7 dB, which is within the measurement accuracy.

Furthermore, using an efficiency threshold of −5 dB, an efficiency bandwidth can be determined. For comparison, the free space Total Radiated Power (TRP) can be between 23 dBm and 31 dBm in the GSM-900 bands for common phones in the market today, and the antenna total efficiency is calculated to average at −4 dB on those bands. For the dual-resonance configuration described herein, however, the measurements show an antenna total efficiency spreading from −3 dB to −7 dB in the GSM-900 bands. The antenna total efficiency at 700 MHz has been reported to peak at −5 dB for the main antenna and −7 dB for the secondary antenna. Therefore, a threshold of −5 dB for evaluating the efficiency bandwidth is realistic, though a tough requirement at 600 MHz. The efficiency bandwidths of this design vary from 205 MHz to 20 MHz. Naturally, as the threshold is lowered the efficiency bandwidth increases. However, the higher the peak efficiency, the wider the efficiency bandwidth for a given threshold.

Compared to the reference design, the use of ground plane extension 130 can enhance the peak total efficiency by about 1.8 dB. Consequently, the efficiency bandwidth at −5 dB for the furthest tuning stage, i.e. state 5, becomes 20 MHz. From an application point of view, the LTE bands 5, 6, 8, 13, 14, 18, 19, 20, 26 and 27 are covered in one operating state, and the LTE bands 12,17 are covered in another operating state.

Figure 7:
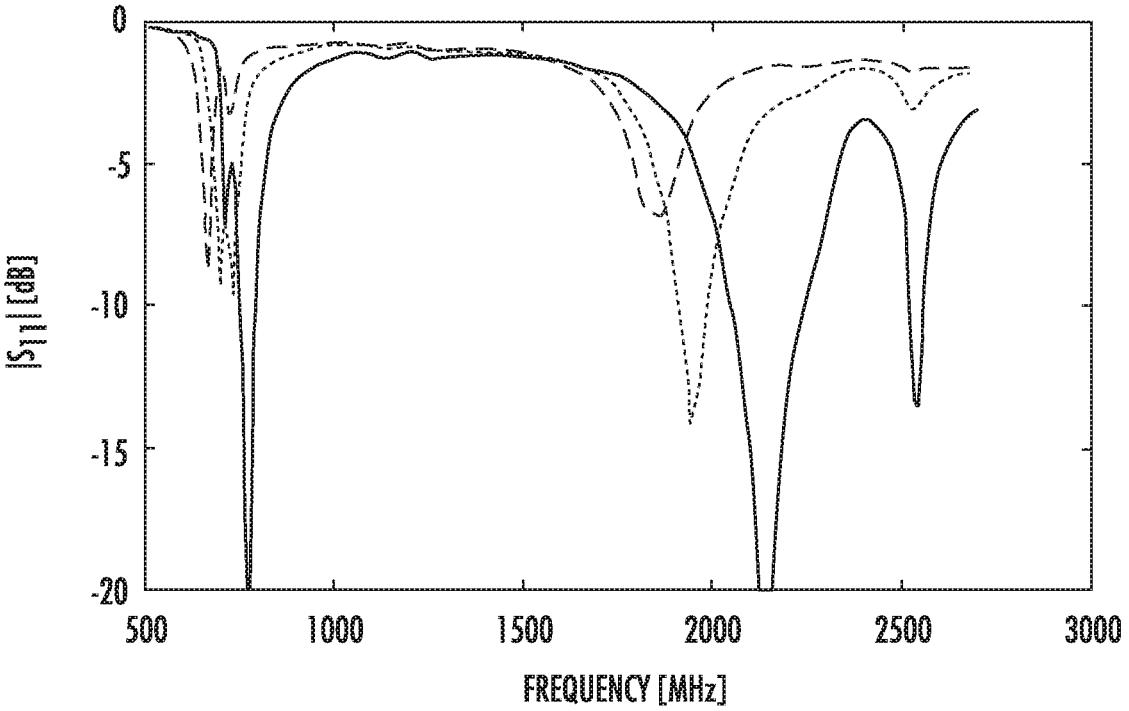
FIG. 7 is a graph illustrating measured return loss for different high-band tuning stages of a tunable multiple-resonance antenna according to an embodiment of the presently disclosed subject matter.
Figure 8:
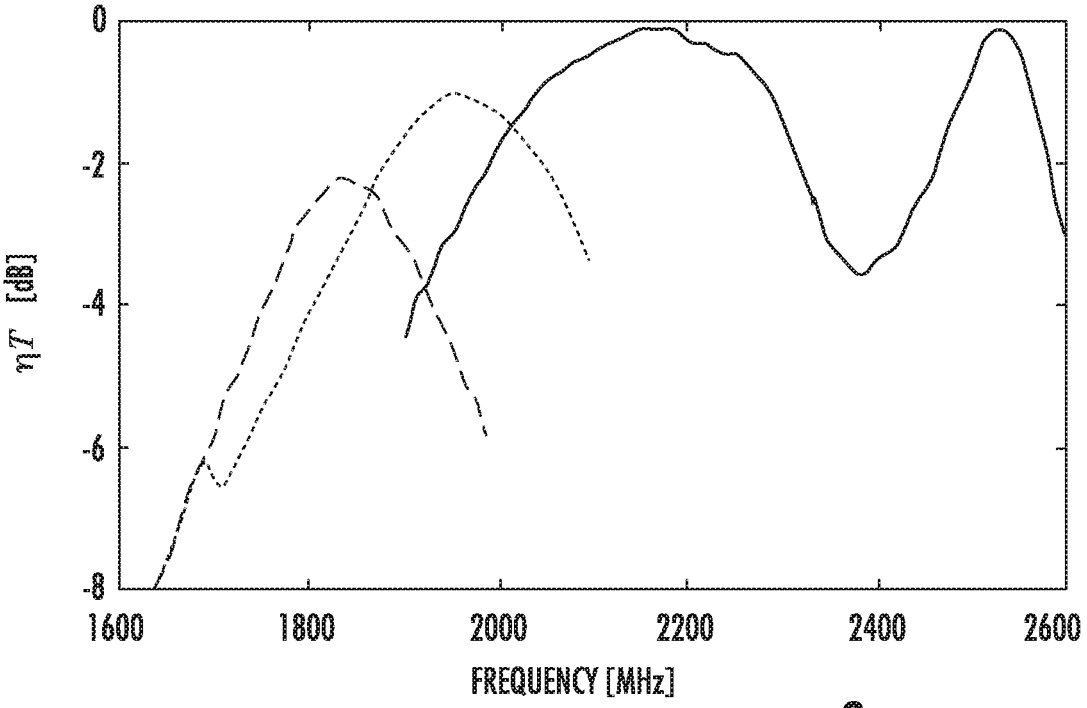
FIG. 8 is a graph illustrating measured efficiency for different high-band tuning stages of a tunable multiple-resonance antenna according to an embodiment of the presently disclosed subject matter.

Referring now to the graphs illustrated in FIGS. 7 and 8, the performance of antenna 100 in higher frequency bands (e.g., for frequencies ranging from 500 MHz to 3000 MHz) is shown. The graph of return loss in FIG. 7 shows that antenna 100 exhibits a resonance in the high bands as well as in the low bands, and FIG. 8 illustrates the total efficiency of this configuration. This resonance can also be tuned. Contrary to low frequencies, however, the inclusion of ground plane extension 130 has substantially no impact on the high band resonance. Using an efficiency bandwidth threshold of −3 dB for this high-band operation, antenna 100 is tunable to cover LTE bands 1 and 38 in one high-band operating state, bands 2, 25, 33, 34, 36, and 37 are covered in a second high-band operating state, and a third high-band operating state covers bands 9 and 35. The frequencies between 2423 MHz and 2343 MHz exhibit a lower efficiency (i.e., down to −3.5 dB). Therefore, band 40 belongs to the first high-band state, though with an efficiency dropping to −3.5 dB. Moreover, the downlink of band 4 is covered in the first high-band state, though the uplink requires to switch to state 3. That is a result of the very large duplex spacing of band 4, (i.e., 400 MHz). The same is valid for band 10. Finally, the uplink of band 7 is also covered in this high-band state.

Figure 9:
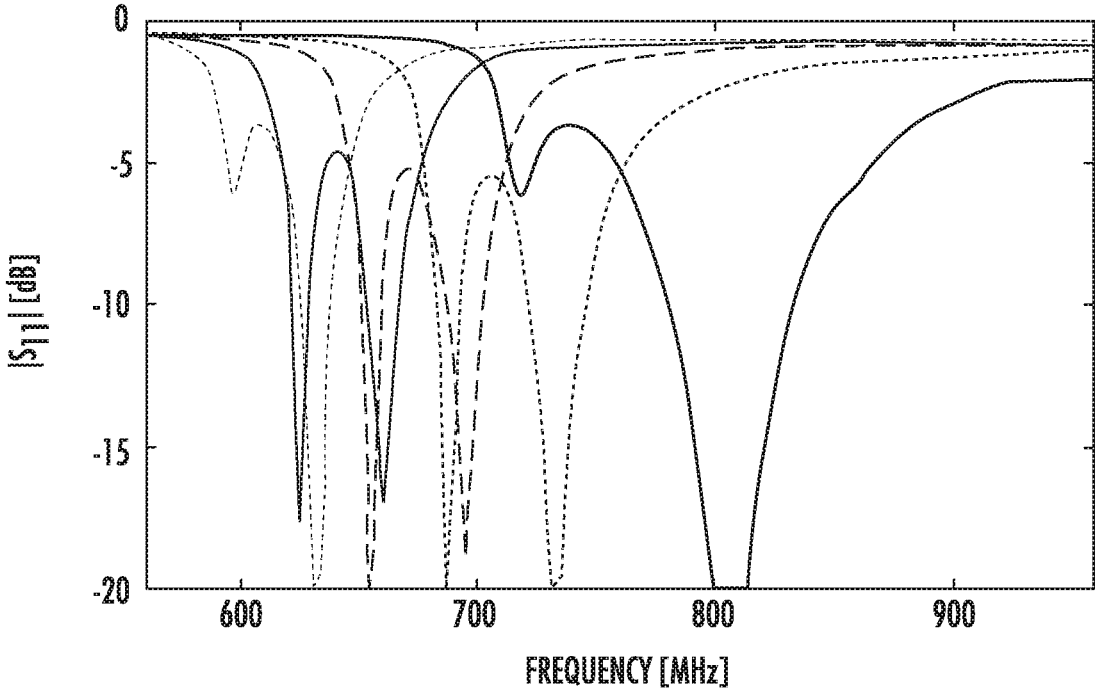
FIG. 9 is a graph illustrating measured return loss for different tuning stages of a tunable multiple-resonance antenna according to an embodiment of the presently disclosed subject matter.
Figure 10:
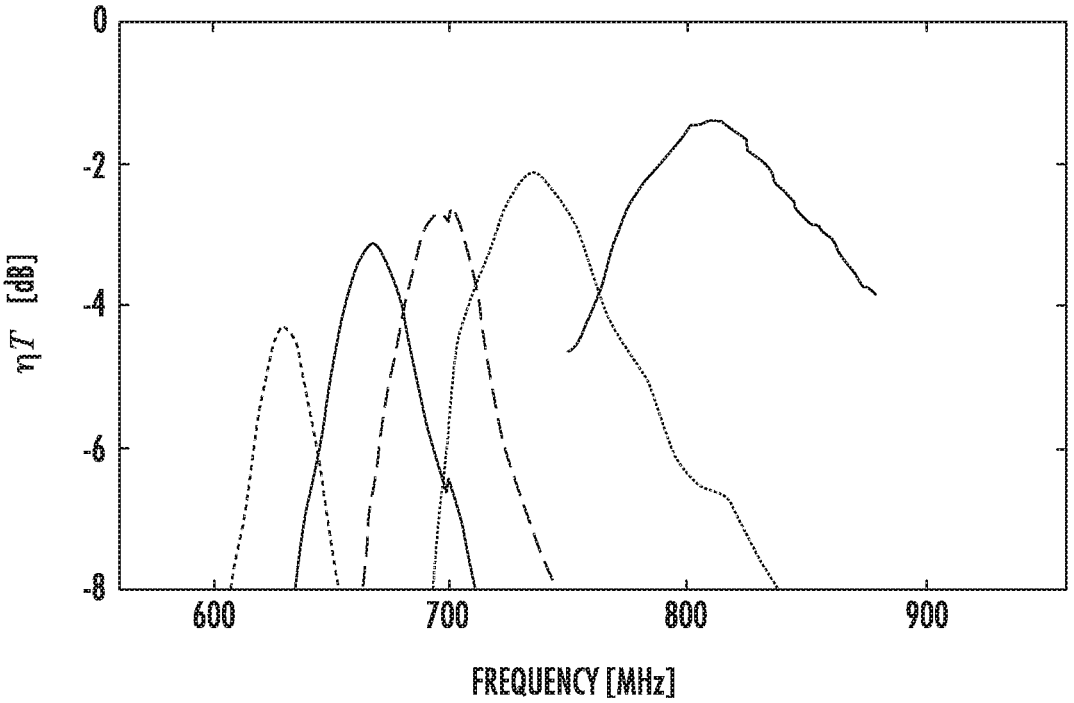
FIG. 10 is a graph illustrating measured efficiency for different tuning stages of a tunable multiple-resonance antenna according to an embodiment of the presently disclosed subject matter.

Referring now to FIGS. 9 and 10, it is shown that even by using a different exemplary configuration of antenna 100 in which first tunable element 122 and second tunable element 132 are provided on two separate MEMS tuners that each exhibit relatively lower maximum capacitance but with improved Q (e.g., a model 1041 MEMS tuner produced by WiSpry, Inc.), the advantageous multiple resonance is again demonstrated at low frequency bands. As shown in FIG. 9, the graph of return loss of this configuration again shows that the design exhibits dual resonance. It is noted, however, that this exemplary configuration cannot cover lower frequencies than 630 MHz due to the lower minimum capacitance of the particular tuner, which shifts the initial resonance frequency by 25 MHz compared to the previously-discussed design. The measured total efficiency of this second exemplary configuration is shown in FIG. 10. The peak total efficiency is measured to be −1.4 dB at 808 MHz and −4.2 dB at 630 MHz. The mismatch loss is negligible at resonance, and the loss of the tuner is negligible, mainly because its Q is very high. From the simulations, it can be seen that the peak of the total radiation loss is improved by 0.8 dB when using the second tuner instead of the previously-referenced tuner (from −4.6 dB for the configuration tested for the results in FIGS. 5 and 6 to −3.8 dB with the configuration tested for FIGS. 9 and 10). Furthermore, the configuration tested for FIGS. 5 and 6 exhibits a measured total efficiency of −3.9 dB at the lowest frequency, while the configuration tested for FIGS. 9 and 10 exhibits a measured total efficiency of −4.2 dB.

That being said, it is noted that simulated efficiencies include mismatch loss, loss from the tuner, and from the fixed inductors. From practical experience, measured efficiencies can be as much as about 1 dB below simulated efficiencies due to thermal loss inaccuracies in the simulator. Even so, the values expected are still very good compared to phones in the market nowadays. With a finer simulation, one can see the dual-resonance response on the efficiency curve. The change in efficiency is due to mismatch loss. Additionally, different tuning settings can vary the resulting efficiency (e.g., due to parasitics).

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A dual-resonant radiating system comprising:

a ground plane;

a radiating coupler spaced apart from but in communication with the ground plane, wherein the radiating coupler is tunable to tune an antenna resonance; and a ground plane extension in communication with the ground plane and tunable to tune a ground plane resonance;

wherein the radiating coupler and the ground plane extension are tunable to independently tune the antenna resonance and the ground plane resonance to achieve a constructively-additive dual-resonance frequency response.

2. The system of claim 1, wherein the radiating coupler comprises an inverted "L" antenna.

3. The system of claim 2, wherein the ground plane extender comprises an inverted "L" antenna.

4. The system of claim 3, wherein the ground plane extender has substantially a same size and shape as the radiating coupler.

5. The system of claim 3, wherein the ground plane extender and the radiating coupler are positioned substantially symmetrically on opposing sides of the ground plane.

6. The system of claim 1, wherein the radiating coupler is connected to a first tunable element configured to tune a resonant frequency of the radiating coupler.

7. The system of claim 6, wherein the first tunable element comprises a first fixed inductor arranged in parallel with a first tunable capacitor.

8. The system of claim 6, wherein the first tunable element is positioned between the radiating coupler and the ground plane.

9. The system of claim 1, wherein the radiating coupler is connected to a series tunable capacitor positioned between a coupler connection of the radiating coupler to the ground plane and a feed node, the series tunable capacitor configured to tune a resonant frequency of the radiating coupler.

10. The system of claim 1, wherein the ground plane extension is connected to a second tunable element configured to tune a resonant frequency of the ground plane.

11. The system of claim 10, wherein the second tunable element comprises a second fixed inductor arranged in parallel with a second tunable capacitor.

12. The system of claim 10, wherein the second tunable element is positioned between the ground plane and the ground plane extension.

13. The system of claim 1, wherein the radiating coupler is connected to a feed node in parallel with a connection of the radiating coupler to the ground plane.

14. A method for operating an antenna, the method comprising:

tuning a first resonant frequency of a radiating coupler that is spaced apart from but in communication with a ground plane; and tuning a second resonant frequency of a combination of the ground plane and a ground plane extension that is in communication with the ground plane, wherein tuning the second resonant frequency is independent from tuning the first resonant frequency;

wherein the first resonant frequency and the second resonant frequency add constructively to form a dual-resonance frequency response.

15. The method of claim 14, wherein tuning a first resonant frequency of a radiating coupler comprises tuning an inductance of a first tunable element connected to the radiating coupler.

16. The method of claim 15, wherein the first tunable element comprises a first fixed inductor arranged in parallel with a first tunable capacitor; and wherein tuning an inductance of the first tunable element comprises tuning a capacitance of the first tunable capacitor.

17. The method of claim 14, wherein tuning a second resonant frequency comprises tuning an inductance of a second tunable element connected to the ground plane extension.

18. The method of claim 17, wherein the second tunable element comprises a second fixed inductor arranged in parallel with a second tunable capacitor; and wherein tuning an inductance of the second tunable element comprises tuning a capacitance of the second tunable capacitor.

19. The method of claim 14, wherein the radiating coupler is connected to a feed node in parallel with a connection of the radiating coupler to the ground plane.

* * * * *